US011217198B2

(12) United States Patent
Muraki

(10) Patent No.: US 11,217,198 B2
(45) Date of Patent: Jan. 4, 2022

(54) DRIVE CIRCUIT, DATA LINE DRIVE CIRCUIT, ELECTRO-OPTICAL DEVICE, ELECTRONIC APPARATUS, AND MOBILE BODY

(71) Applicant: SEIKO EPSON CORPORATION, Tokyo (JP)

(72) Inventor: Norichika Muraki, Hara-mura (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/801,937

(22) Filed: Feb. 26, 2020

(65) Prior Publication Data

US 2020/0273421 A1 Aug. 27, 2020

(30) Foreign Application Priority Data

Feb. 27, 2019 (JP) ..... JP2019-034510

(51) Int. Cl.
*G09G 3/36* (2006.01)

(52) U.S. Cl.
CPC ..... *G09G 3/3688* (2013.01); *G09G 2310/027* (2013.01); *G09G 2310/08* (2013.01); *G09G 2380/10* (2013.01)

(58) Field of Classification Search
CPC ..... G09G 2310/027; G09G 2310/0272; G09G 2310/0286; G09G 2330/08; G09G 2300/0819; G09G 2320/0295
See application file for complete search history.

(56) References Cited

U.S. PATENT DOCUMENTS

| | | | | |
|---|---|---|---|---|
| 9,514,713 | B2 | 12/2016 | Lee et al. | |
| 2005/0200590 | A1 | 9/2005 | Kumekawa | |
| 2005/0253833 | A1 | 11/2005 | Teshirogi et al. | |
| 2011/0157134 | A1* | 6/2011 | Ogura | G09G 3/20 345/211 |
| 2011/0199355 | A1* | 8/2011 | Watanabe | G09G 3/3688 345/211 |
| 2016/0055785 | A1 | 2/2016 | Kondo | |
| 2017/0255504 | A1* | 9/2017 | Fletcher | G09G 3/006 |
| 2018/0268761 | A1* | 9/2018 | Kuo | G09G 3/3275 |
| 2020/0161377 | A1* | 5/2020 | Aggarwal | G09G 5/006 |

FOREIGN PATENT DOCUMENTS

| | | |
|---|---|---|
| CN | 1667690 | 9/2005 |
| CN | 1697011 | 11/2005 |
| JP | 2016-045223 A | 4/2016 |

* cited by examiner

*Primary Examiner* — Dong Hui Liang
(74) *Attorney, Agent, or Firm* — Rankin, Hill & Clark LLP

(57) ABSTRACT

A drive circuit of an electro-optical panel (10) is provided with a driving signal generation unit (240) that output a plurality of driving signals to the electro-optical panel (10), a control circuit (400) that outputs display image data indicating an image to be displayed in the electro-optical panel (10), a processing circuit (210) configured to generate input data to the driving signal generation unit (240) based on the display image data, and an error detection circuit (410) configured to detect an error in the input data.

13 Claims, 7 Drawing Sheets

DRIVE CIRCUIT, DATA LINE DRIVE CIRCUIT, ELECTRO-OPTICAL DEVICE, ELECTRONIC APPARATUS, AND MOBILE BODY

The present application is based on, and claims priority from JP Application Serial Number 2019-034510, filed Feb. 27, 2019, the disclosure of which is hereby incorporated by reference herein in its entirety.

BACKGROUND

1. Technical Field

The present disclosure relates to drive circuits of electro-optical devices.

2. Related Art

In recent years, in electro-optical devices such as liquid-crystal display devices, the resolution of a display panel has been increased in order to display high definition images. In accordance with this, the transmission frequency of image data inside of devices has increased, and the operating conditions thereof have become stringent. Meanwhile, in on-board electro-optical devices, errors that occur in image data needs to be reliably detected, and high error detection capability is required.

Therefore, in a liquid-crystal display device described in JP-A-2016-45223, a driver receives image data that has been coded to detect an error from a drive control unit. Then, in the driver, an error detection circuit performs error detection on the received image data, and retains the resultant image data in a data latch, and a DAC (Digital Analog Converter) converts the image data retained in the data latch to a tone voltage. Therefore, in this liquid-crystal display device, an error that occurs in image data in a section from the drive control unit to the error detection circuit in the driver can be detected.

However, in a technique disclosed in JP-A-2016-45223, there is a problem in that, if an error occurs in image data in a section from an output portion of the error detection circuit to an input portion of the DAC, the error cannot be detected.

SUMMARY

A drive circuit according to one aspect of the disclosure includes: a driving signal generation unit that outputs a driving signal to an electro-optical panel; a control circuit that outputs display image data indicating an image to be displayed in the electro-optical panel; and a processing circuit configured to generate input data to the driving signal generation unit based on the display image data, wherein the processing circuit includes a data transfer portion configured to transfer the input data to the control circuit, and the control circuit includes an error detection circuit configured to detect an error in the input data.

A drive circuit according to another aspect of the disclosure includes: a driving signal generation unit that outputs a driving signal to an electro-optical panel; a control circuit that outputs display image data indicating an image to be displayed in the electro-optical panel; and a processing circuit configured to generate input data to the driving signal generation unit based on the display image data, wherein the processing circuit includes an error detection circuit configured to detect an error in the input data.

A data line drive circuit according to one aspect of the disclosure includes: a driving signal generation unit that outputs a driving signal to an electro-optical panel; an input data storage that receives display image data indicating an image to be displayed in the electro-optical panel, and outputs the received data to the driving signal generation unit as input data; and a data transfer portion configured to transfer the input data to the outside.

A data line drive circuit according to another aspect of the disclosure includes: a driving signal generation unit that outputs a driving signal to an electro-optical panel; an acceptor that receives display image data indicating an image to be displayed in the electro-optical panel and error detection data generated from the display image data; an input data storage that outputs the display image data to the driving signal generation unit as input data; an error detection computation portion configured to generate error detection data from the input data; and a collator configured to collate error detection data generated from the display image data with error detection data generated from the input data.

BRIEF DESCRIPTION OF THE DRAWINGS

The disclosure will be described with reference to the accompanying drawings, wherein like numbers reference like elements.

DESCRIPTION OF EXEMPLARY EMBODIMENTS

Figure 1:
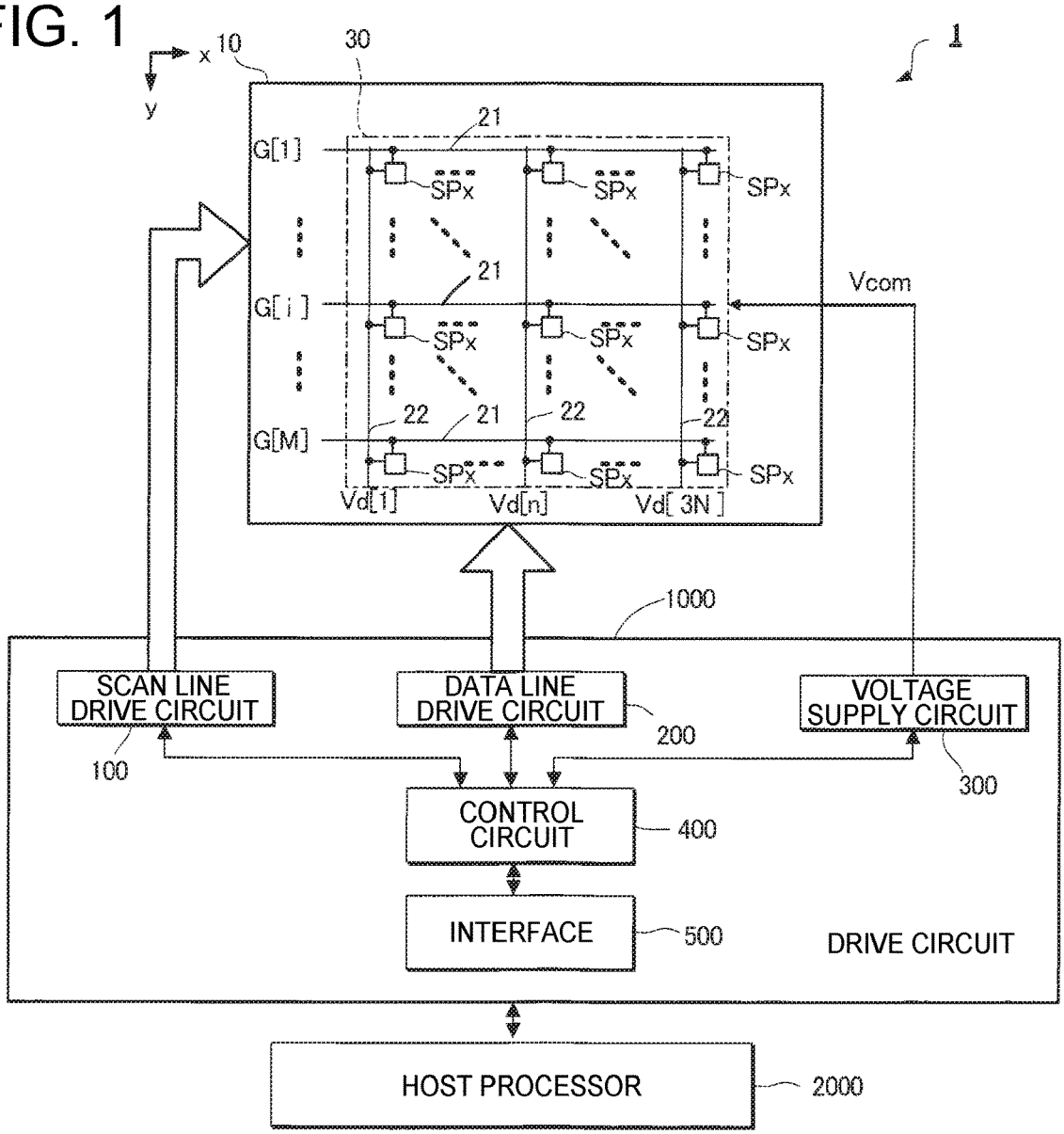
FIG. 1 is a block diagram illustrating a configuration of an electro-optical device including a drive circuit according to a first embodiment.

Hereinafter, embodiments will be described with reference to the drawings. Note that, in the drawings, the size and scale of each unit are appropriately changed from the actual size and scale thereof. Also, although the following embodiments are limited in various ways so as to be technically preferable, the embodiments are not limited thereto.

A. First Embodiment

FIG. 1 is a block diagram of an electro-optical device 1 including a drive circuit 1000 according to a first embodiment. The electro-optical device 1 includes an electro-optical panel 10, the drive circuit 1000 that drives the electro-optical panel 10, and a host processor 2000 that controls the drive circuit 1000. The host processor 2000 is an ECU (Electronic Control Unit), for example. The electro-optical device 1 is a device that uses an electro-optical substance whose optical property changes when electric energy is applied. Examples of the electro-optical substances include a liquid crystal, an organic electroluminescence substance, a charged substance used in an electrophoretic element, and the like.

M scan lines 21 of a first row to an $M^{th}$ row that extend in an x direction and 3N data lines 22 of a first column to a $3N^{th}$ column that extend in a y direction that intersects the x direction are formed in the electro-optical panel 10. Note that M and N are natural numbers. In the electro-optical panel 10, sub-pixel circuits SPx respectively corresponding to one of red, green, and blue colors are arranged in a matrix of M rows vertically and 3N columns horizontally corresponding to the respective intersections of the scan lines 21 and the data lines 22. Also, three sub-pixel circuits SPx that are successively arranged in the x direction, and are respectively corresponding to red, green, and blue colors, constitute one pixel circuit. Various types of modes are conceivable with respect to the arrangement of the sub-pixel circuits SPx for red, green, and blue colors, but in the present embodiment, a $(3j-2)^{th}$ column, a $(3j-1)^{th}$ column, and a $3j^{th}$ column of the sub-pixel circuits SPx that are arranged in M rows vertically and 3N columns horizontally respectively correspond to red, green, and blue colors, for example. Note that j is a natural number from one to N. Here, the pixel in the first column, that is, three data lines 22 corresponding to sub-pixels from the first column to the third column, corresponds to a first data line, for example. Also, the pixel in the second column, that is, three data lines 22 corresponding to sub-pixels from the fourth column to the sixth column, corresponds to a second data line, for example.

As shown in FIG. 1, the drive circuit 1000 includes a scan line drive circuit 100, a data line drive circuit 200, the voltage supply circuit 300, a control circuit 400, and an interface 500.

Input image data Din is supplied from the host processor 2000 to the control circuit 400 via the interface 500 in synchronization with a synchronization signal. Here, the input image data Din is data for defining a tone to be displayed in each sub-pixel circuit SPx. For example, the input image data Din may be 8-bit digital data for defining a tone to be displayed in each sub-pixel. Also, the synchronization signal is a signal including a vertical synchronizing signal Vsync, a horizontal synchronizing signal Hsync, and a dot clock signal, for example.

The control circuit 400 generates various types of control signals based on the synchronization signal supplied from the host processor 2000, and controls the scan line drive circuit 100, the data line drive circuit 200, and the voltage supply circuit 300. Also, the control circuit 400 generates display image data DRGB indicating the image to be displayed in the electro-optical panel 10 based on the input image data Din supplied from the host processor 2000, and outputs the generated display image data DRGB to the data line drive circuit 200. The control signals generated by the control circuit 400 includes a first clock CLK1, a second clock CLK2, a third clock CLK3, a shift enable signal ENS, and the like. The roles of these signals will be clarified in the description of the operations of the present embodiment in order to avoid duplicate descriptions.

The scan line drive circuit 100 sequentially selects one scan line 21 out of the scan lines 21 of the first to $M^{th}$ rows for each one horizontal scan period H by supplying scan signals G[i] to the respective scan lines 21 of the electro-optical panel 10 in synchronization with the horizontal synchronizing signal Hsync. Note that i is a natural number from one to M. Specifically, the scan line drive circuit 100 selects the scan line 21 of the $i^{th}$ row by bringing the scan signal G[i] to an active level.

The data line drive circuit 200 outputs a plurality of driving signals for driving the electro-optical panel 10, specifically data signals Vd[n] for driving the 3N data lines 22, in synchronization with the selection of the scan line 21 by the scan line drive circuit 100. Note that n is a number for designating one of the sub-pixels that are arranged along the x direction, and is a natural number from one to 3N. When one pixel is taken as the unit of the data signal, the data signals Vd[1], Vd[2], and Vd[3] correspond to a first driving signal, and the data signals Vd[4], Vd[5], and Vd[6] correspond to a second driving signal, for example. The voltage supply circuit 300 supplies a common electrode voltage Vcom to each sub-pixel circuit SPx.

Figure 2:
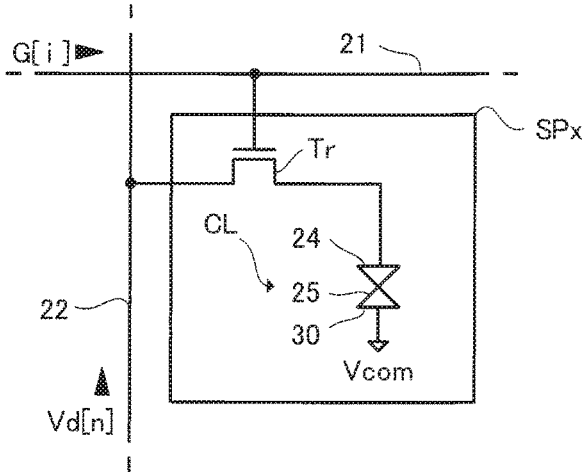
FIG. 2 is a diagram illustrating a configuration of a sub-pixel circuit in the embodiment.

FIG. 2 is a circuit diagram of each sub-pixel circuit SPx provided in the electro-optical panel 10. As shown in the diagram, each sub-pixel circuit SPx includes a liquid crystal element CL and a write transistor Tr. The liquid crystal element CL includes the common electrode 30, a sub-pixel electrode 24, and a liquid crystal 25 provided between the common electrode 30 and the sub-pixel electrode 24. Here, the common electrode 30 is provided so as to oppose the sub-pixel electrodes 24 of all of the sub-pixels in the electro-optical panel 10. The common electrode voltage Vcom supplied from the voltage supply circuit 300 is applied to this common electrode 30. The liquid crystal 25 of the liquid crystal element CL changes its transmittance according to the voltage applied to the liquid crystal element CL, more accurately, according to the voltage applied between the common electrode 30 and the sub-pixel electrode 24.

In the present embodiment, the write transistor Tr is an N-channel transistor whose gate is connected to the scan line 21 and that is provided between the liquid crystal element CL and the data line 22 and controls the electrical connection therebetween. The electrical connection means either conductive or non-conductive. When the scan signal G[i] is brought to an active level, the write transistors Tr of the respective sub-pixel circuits SPx on the $i^{th}$ row transitions to an on state at the same time.

At a timing at which the scan line 21 corresponding to a sub-pixel circuit SPx is selected, and the write transistor Tr of the sub-pixel circuit SPx is controlled to be in an on state, a data signal Vd[n] is supplied to the sub-pixel circuit SPx from the data line 22. As a result, the liquid crystal 25 of the sub-pixel circuit SPx is set to have transmittance according to the data signal Vd[n], and the sub-pixel corresponding to the sub-pixel circuit SPx displays the tone according to the data signal Vd[n].

Figure 3:
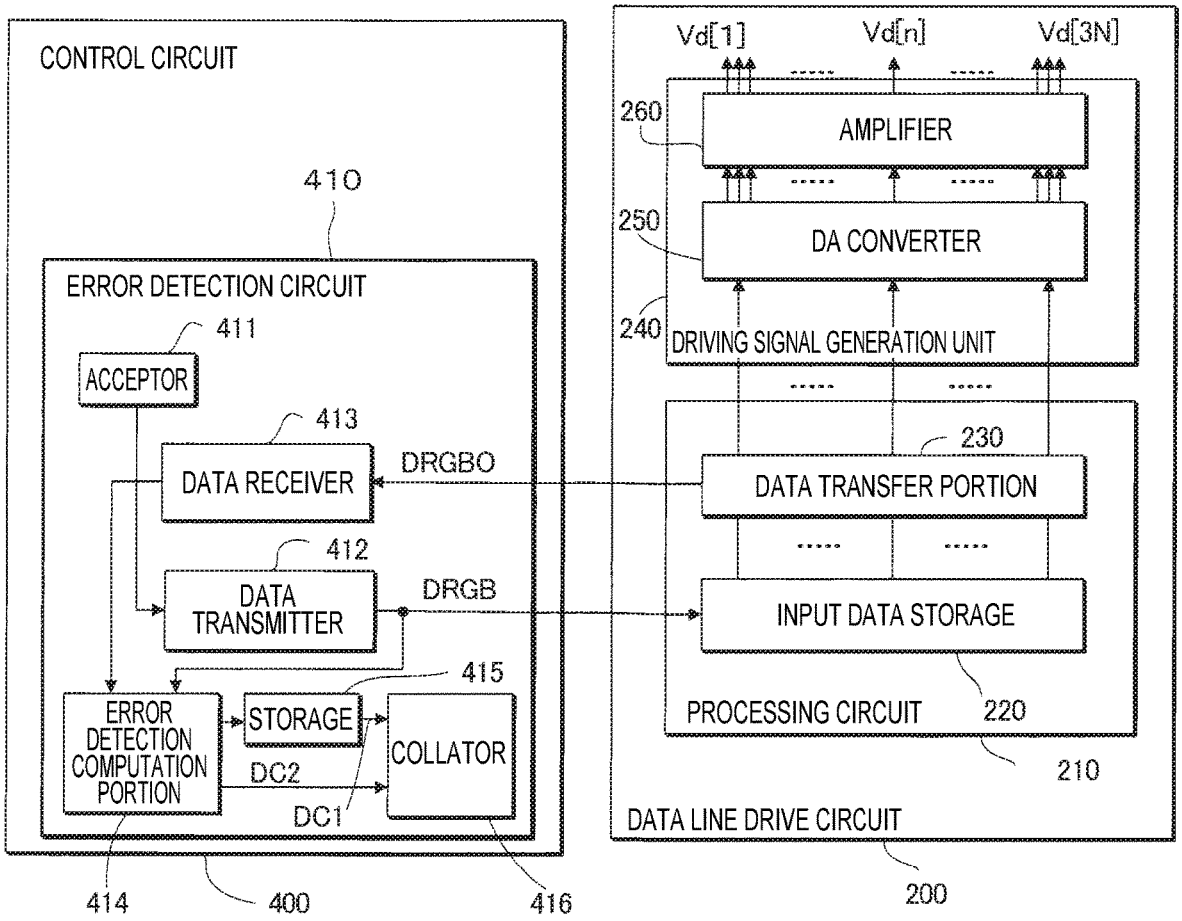
FIG. 3 is a block diagram illustrating a configuration of a control circuit and a data line drive circuit in the drive circuit.

FIG. 3 is a block diagram illustrating an exemplary configuration of the control circuit 400 and the data line drive circuit 200 in the present embodiment.

The data line drive circuit 200 includes a processing circuit 210 and a driving signal generation unit 240. The processing circuit 210 includes an input data storage 220 and a data transfer portion 230.

The input data storage 220 is a circuit that stores display image data DRGB constituted by a plurality of pieces of image data, and outputs the plurality of pieces of image data in the display image data DRGB to the driving signal generation unit 240 as input data. Specifically, the input data storage 220 receives display image data DRGB constituted by 3N sub-pixel's worth of image data from the control circuit 400 for each one horizontal scan period, and stores the received data. Also, the input data storage 220 applies the stored 3N sub-pixel's worth of display image data DRGB to the driving signal generation unit 240 as input data constituted by a plurality of pieces of image data.

Here, the image data that defines tones of sub-pixels that are connected to three data lines 22 of the first to third columns of the electro-optical panel 10 corresponds to first image data, for example. Also, the image data that defines tones of sub-pixels that are connected to three data lines 22 of the fourth to sixth columns of the electro-optical panel 10 corresponds to second image data, for example. The display image data DRGB includes the first image data and the second image data. Also, the input data storage 220 outputs input data including the first image data and the second image data.

The driving signal generation unit 240 is a circuit that outputs a plurality of driving signals, that is, data signals Vd[n], to the electro-optical panel 10, and is constituted by a DA converter 250 and an amplifier 260. Note that n is a natural number from one to 3N.

The DA converter 250 DA-converts, for each sub-pixel, the input data from the input data storage 220, and outputs 3N sub-pixel's worth of analog signals. The amplifier 260 amplifies these analog signals, and outputs the amplified signals to the 3N data lines 22 (refer to FIG. 1) of the electro-optical panel 10 as the data signals Vd[n]. Note that n is a natural number from one to 3N.

The data transfer portion 230 is a circuit that transfers the input data to the driving signal generation unit 240 to the control circuit 400. Specifically, the data transfer portion 230 performs a parallel input operation for taking in the pieces of input data including the first image data and the second image data described above from the input data storage 220 at the same time and a serial output operation for sequentially outputting the taken-in pieces of input data to the control circuit 400 by a predetermined unit as image data DRGBO. That is, the image data DRGBO is input data that is transferred from the data transfer portion 230 to the control circuit 400.

The control circuit 400 includes an error detection circuit 410 that performs error detection on the input data to the driving signal generation unit 240. This error detection circuit 410 includes an acceptor 411, a data transmitter 412, a data receiver 413, an error detection computation portion 414, a storage 415, and a collator 416.

The acceptor 411 accepts the input image data Din from the host processor 2000. The data transmitter 412 is a circuit that takes out one horizontal scan period's worth of display image data DRGB from the input image data Din for each horizontal scan period, and transmits the taken-out data to the data line drive circuit 200. The data receiver 413 is a circuit that receives the image data DRGBO that is transferred from the data transfer portion 230. The error detection computation portion 414 executes computation processing for generating error detection data DC1 from the display image data DRGB that is transmitted to the data line drive circuit 200, and computation processing for generating error detection data DC2 from the image data DRGBO received by the data receiver 413. The error detection data is a CRC (Cyclic Redundancy Check) code, for example. The storage 415 stores the former error detection data DC1. The collator 416 collates the error detection data DC1 stored in the storage 415 with the error detection data DC2 generated by the error detection computation portion 414, and determines that, if these two pieces of data do not match, an error has occurred in the input data to the driving signal generation unit 240.

Figure 4:
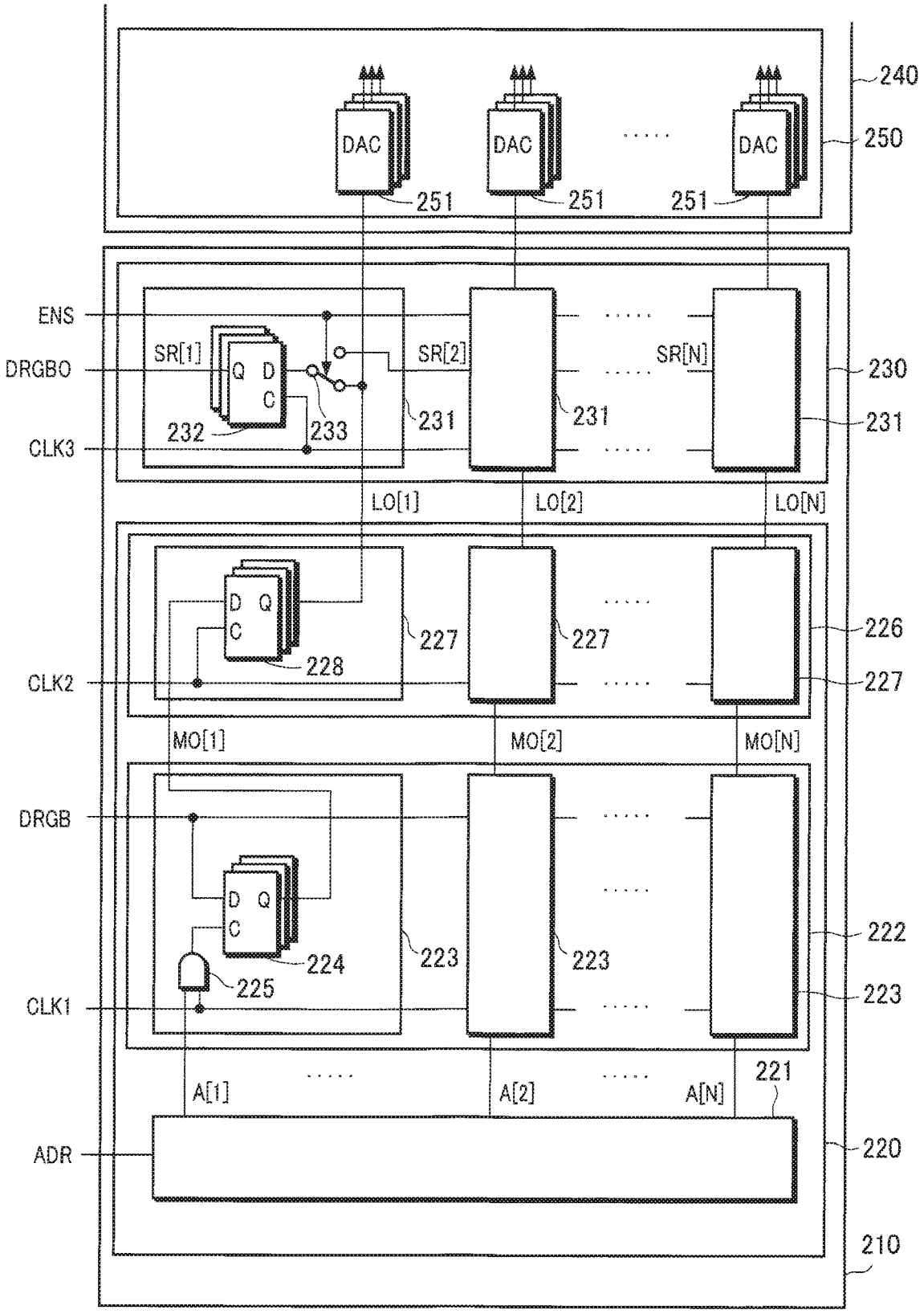
FIG. 4 is a block diagram illustrating a configuration of a processing circuit in the data line drive circuit.

FIG. 4 is a block diagram illustrating a specific exemplary configuration of the data line drive circuit 200. As shown in FIG. 4, the input data storage 220 includes an address decoder 221, a first register 222, and a second register 226.

The first register 222 is constituted by N stages 223. Also, the second register 226 is constituted by N stages 227. Also, the data transfer portion 230 is constituted by N stages 231. Here, in the diagram, the leftmost stage is the first stage, the adjacent stage on the right is the second stage, and the third to the $N^{th}$ stages are arranged on the right, in each of the first register 222, the second register 226, and the data transfer portion 230. In contrast that the data signals Vd[n] correspond to the respective sub-pixels arranged in the x direction, the stages in each of the first register 222, the second register 226, and the data transfer portion 230 correspond to respective pixels arranged in the x direction.

Three sub-pixel's worth of 24-bit image data for one pixel and address data ADR are applied to the input data storage 220 in synchronization with the first clock CLK1. Here, the address data ADR is data indicating the number j of the stage 223 to which the data signal is to be written in the first register 222, and changes from one to N in one horizontal scan period. The address decoder 221 outputs write enable signals A[j] to the first register 222 based on the address data ADR. Note that j is a natural number from one to N. Also, the address decoder 221 activates only the write enable signal A[j], of the write enable signals A[j], corresponding to the number j indicated by the address data ADR to an active level, and keeps the other write enable signals A[≠] at an inactive level.

Each stage 223 is constituted by a 24-bit latch 224 and an AND gate 225. Here, the output terminal of the AND gate 225 is connected to a clock input terminal C of the latch 224. 24-bit display image data DRGB supplied from the control circuit 400 is applied to the data input terminal D of the latch 224 in each stage 223. Also, the first clock CLK1 is applied to one input terminal of the AND gate 225 in each stage 223. Also, the write enable signal A[j] is applied to the other input terminal of the AND gate 225 in the $j^{th}$ stage 223.

Each stage 227 of the second register 226 is constituted by a 24-bit latch 228. Data MO[j] of the latch 224 in the $j^{th}$ stage 223 is applied to a data input terminal D of the latch 228 in the $j^{th}$ stage 227. The second clock CLK2 is applied to a clock input terminal C of the latch 228 in each stage 227. The 24-bit data retained in the latch 228 in the $j^{th}$ stage 227 is output as input data LO[j] to the driving signal generation unit 240. This input data LO[j] is divided into pieces of 8-bit data, and these pieces of 8-bit data are respectively applied to three DACs 251, of 3N DACs 251 that constitute the DA converter 250. These three DACs 251 correspond to three data lines 22 of the $(3j-2)^{th}$ column, the $(3j-1)^{th}$ column, and the $3j^{th}$ column in the electro-optical panel 10.

Each stage 231 in the data transfer portion 230 is constituted by a 24-bit register 232 and a switch 233. The third clock CLK3 is applied to a clock input terminal C of the register 232 in each stage 231. The register 232 in the $j^{th}$ stage 231 outputs data SR[j]. The switch 233 in the $j^{th}$ stage 231 switches the input data to the register 232 between the input data LO[j] to be applied to the DA converter 250 from the $j^{th}$ stage 227 and data SR[j+1] of the register 232 in the $(j+1)^{th}$ stage 231 based on the shift enable signal ENS applied from the control circuit 400.

Next, the operations of the present embodiment will be described. The control circuit 400 periodically generates the vertical synchronizing signals Vsync for designating the start timings of vertical scan periods, and periodically generates the horizontal synchronizing signals Hsync for designating the start timings of horizontal scan periods in each vertical scan period.

The scan line drive circuit 100 sequentially selects a scan line 21 every time the horizontal synchronizing signal Hsync is generated in one vertical scan period, activates the scan signal G[i] to the selected scan line 21 to an active level, and keeps the scan signals to the other scan lines 21 at an inactive level.

The data line drive circuit 200 receives N pixels' worth of display image data DRGB, that is 3N sub-pixel's worth of display image data DRGB from the control circuit 400 every time the horizontal synchronizing signal Hsync is generated, generates input data from the display image data DRGB, and applies the generated input data to the driving signal generation unit 240, and the driving signal generation unit 240 drives the 3N sub-pixel's worth of data lines 22. Also, the data line drive circuit 200 transfers the input data applied to the driving signal generation unit 240 to the control circuit 400 using the data transfer portion 230.

Figure 5:
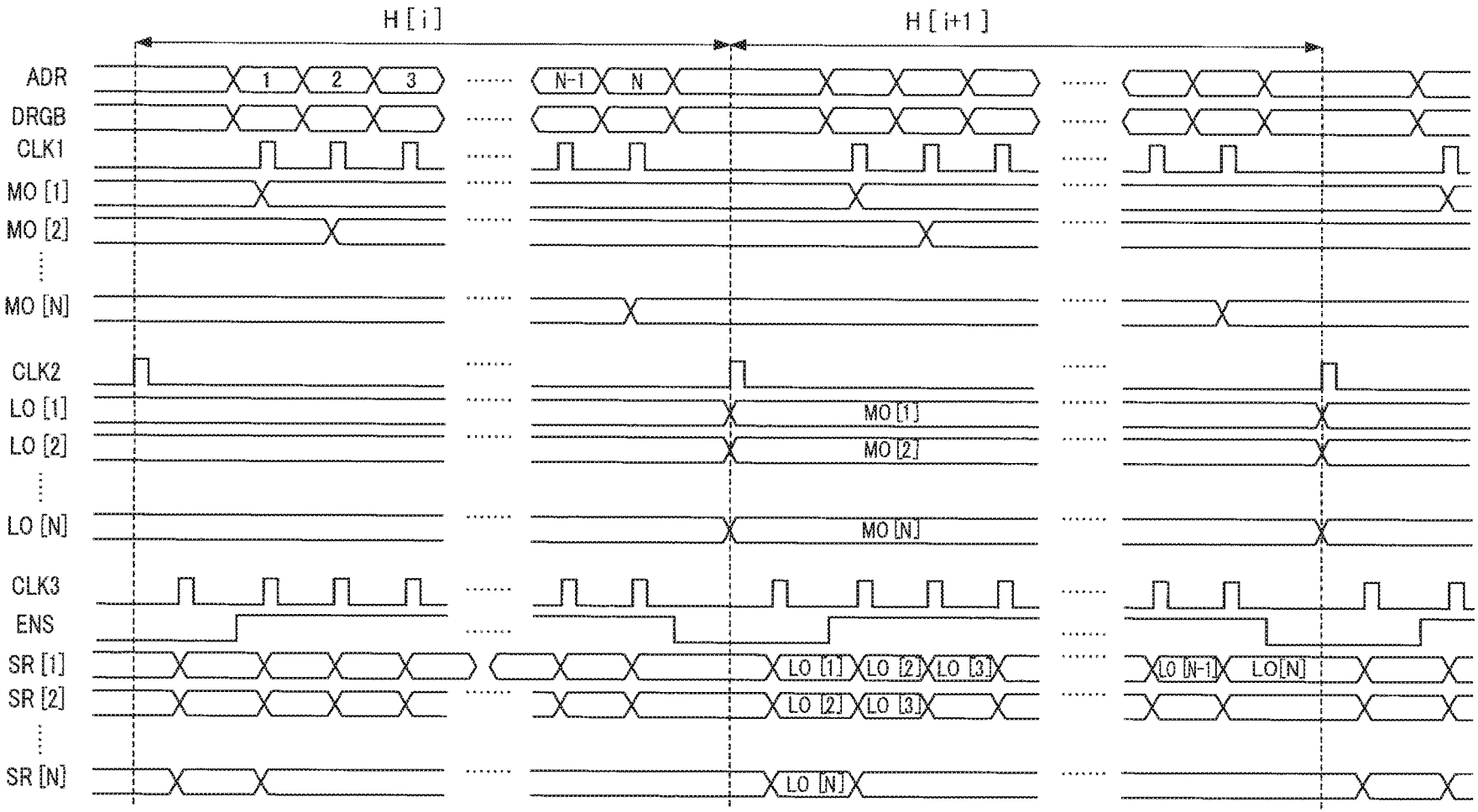
FIG. 5 is a time chart illustrating operations of the data line drive circuit.

FIG. 5 is a time chart illustrating exemplary operations of the data line drive circuit 200. In FIG. 5, the operations of the units of the data line drive circuit 200 in a certain horizontal scan period H[i] and the next horizontal scan period H[i+1] are shown.

In the horizontal scan period H[i], the control circuit 400 supplies the display image data DRGB indicating an image to be displayed in N pixels, that is 3N sub-pixels, that are arranged along one scan line 21 and the address data ADR indicating the number j described above to the data line drive circuit 200 pixel by pixel in synchronization with the first clock CLK1. Here, in the control circuit 400, the error detection computation portion 414 generates error detection data DC1 from the display image data DRGB, and the storage 415 stores the error detection data DC1.

In the data line drive circuit 200, the address decoder 221 decodes the address data ADR, and outputs the write enable signal A[j] at an active level and the other write enable signals A[≠j] at an inactive level. In a period in which the address data ADR indicates the number j and the write enable signal A[j] is at an active level, one pixel's worth of display image data DRGB, that is, three sub-pixel's worth of display image data DRGB is written into the latch 224 of the $j^{th}$ stage 223 in the first register 222 by the first clock CLK1. This data that has been written is output as data MO[j]. As a result of the number j indicated by the address data ADR changing from one to N, N pixel's worth of display image data DRGB is written into the latches 224 of the N stages 223.

Thereafter, the second clock CLK2 is applied from the control circuit 400 to the data line drive circuit 200. The data MO[j] stored in the latch 224 of the $j^{th}$ stage 223 is written into the latch 228 of the $j^{th}$ stage 227 in the second register 226 by this second clock CLK2. The data written into the latch 228 of the $j^{th}$ stage 227 is output as input data LO[j] to the driving signal generation unit 240.

Meanwhile, in each horizontal scan period, the control circuit 400, after outputting the third clock CLK3 once after bringing the shift enable signal ENS to a low level, outputs the third clock CLK3 N times after bringing the shift enable signal ENS to a high level to the data line drive circuit 200.

When the third clock CLK3 is generated in a period in which the shift enable signal ENS is at a low level in the horizontal scan period H[i+1], in the $j^{th}$ stage 231 in the data transfer portion 230, the input data LO[j] stored in the latch 228 of the $j^{th}$ stage 227 in the second register 226 is selected by the switch 233 and written into the register 232 by the third clock CLK3. As a result, data SR[j]=LO[j] is output from the register 232 of the $j^{th}$ stage 231 in the data transfer portion 230. Such operations are performed in each stage 231 in the data transfer portion 230, and a parallel input operation is performed by the data transfer portion 230 as a whole.

Thereafter, when the shift enable signal ENS is brought to a high level, in the $j^{th}$ stage 231 in the data transfer portion 230, data SR(j+1) of the latch 228 of the $(j+1)^{th}$ stage 231 is selected by the switch 233. Then, when the third clock CLK3 is generated, the data SR(j+1) of the register 232 of the $(j+1)^{th}$ stage 231 is written into the register 232 of the $j^{th}$ stage 231. Such a serial output operation is performed every time the third clock CLK3 is generated in the data transfer portion 230.

In the serial output operation, the output data of the register 232 of the first stage 231 changes from SR[1] to SR[2], . . . , and SR[N] every time the third clock CLK is generated. The pieces of data SR[1], SR[2], . . . , SR[N] that are sequentially output from the register 232 of the first stage 231 are transmitted to the control circuit 400 as the image data DRGBO.

In the control circuit 400, this image data DRGBO is received by the data receiver 413. The error detection computation portion 414 generates error detection data DC2 from the received image data DRGBO. The collator 416 collates the generated error detection data DC2 with the error detection data DC1 stored in the storage 415, and determines that an error has occurred in the input data to the driving signal generation unit 240 if these two pieces of data do not match.

As described above, in the present embodiment, the electro-optical device 1 includes the driving signal generation unit 240 that outputs the driving signals to the electro-optical panel 10, the control circuit 400 that outputs the display image data DRGB indicating an image to be displayed in the electro-optical panel 10, and the processing circuit 210 that generates the pieces of input data LO[1], L[2], . . . , and LO[N] to the driving signal generation unit 240 based on the display image data DRGB. Also, the processing circuit 210 includes the data transfer portion 230 that transfers the pieces of input data LO[1], L[2], . . . , and LO[N] to the control circuit 400, and the control circuit 400 includes the error detection circuit 410 that detects an error in the pieces of input data LO[1], L[2], . . . , and LO[N]. Therefore, according to the present embodiment, capability of detecting an error in the input data to the driving signal generation unit 240 in the electro-optical device 1 can be improved.

Also, in the present embodiment, the driving signal includes the first driving signal and the second driving signal, the electro-optical panel 10 includes the first data line and the second data line, the processing circuit 210 includes the input data storage 220 that stores the display image data DRGB including the first image data and the second image data, and output input data including the stored first image data and second image data, and the driving signal generation unit 240 outputs the first driving signal to the first data line based on the first image data in the input data, and outputs the second driving signal to the second data line based on the second image data in the input data. Also, the data transfer portion 230 performs the parallel input operation for taking in the pieces of input data from the input data storage 220 at the same time and the serial output operation for sequentially outputting the taken-in pieces of input data including the first image data and the second image data to the control circuit 400. Therefore, according to the present embodiment, error detection can be performed with respect to input data including a plurality of pieces of image data for generating a plurality of driving signals. Also, according to the present embodiment, since the pieces of input data are transferred from the processing circuit to the control circuit by performing a serial output operation, the number of signal lines used for the data transfer can be reduced relative to the case where the data transfer is performed by a parallel output operation.

Also, in the present embodiment, the input data storage 220 sequentially stores pieces of display image data DRGB including the first image data and the second image data in synchronization with the first clock CLK1, and outputs the stored pieces of display image data DRGB including the first image data and the second image data as the pieces of input data in synchronization with the second clock CLK2, and the data transfer portion 230 performs the serial output operation in synchronization with the third clock CLK3 in a period in which the input data storage 230 stores pieces of display image data including the first image data and the second image data. Therefore, according to the present embodiment, pieces of input data to the driving signal generation unit 240 can be effectively transferred to the control circuit 400.

Also, in the present embodiment, the error detection circuit 410 includes the storage 415 that stores error detection data DC1 generated from the display image data DRGB that the control circuit 400 outputs to the processing circuit 210, the error detection computation portion 414 that generates error detection data DC2 from the input data that has been transferred from the data transfer portion 230, and the collator that collates the error detection data DC1 with the error detection data DC2. Therefore, according to the present embodiment, an error in the input data to the driving signal generation unit 240 can be detected by collating the error detection data DC1 with the error detection data DC2.

Also, in the present embodiment, the error detection computation portion 414 generates error detection data DC1 from the display image data DRGB. That is, the error detection computation portion 414 generates both pieces of the error detection data DC1 and DC2. In this way, in the present embodiment, the error detection computation portion 414 can be effectively used.

Also, in the present embodiment, the data line drive circuit 200 is provided with the driving signal generation unit 240 that outputs driving signals to the electro-optical panel 10, the input data storage 220 that receives the display image data DRGB indicating an image to be displayed in the electro-optical panel 10 and output the received data to the driving signal generation unit 240 as input data, and the data transfer portion 230 that transfers the input data to the outside. Therefore, when the data line drive circuit 200 is provided in the electro-optical device 1, an error in the input data to the driving signal generation unit 240 can be detected at the outside of the data line drive circuit 200, for example, inside of the control circuit 400. Also, according to the present embodiment, since the data line drive circuit 200 is provided with the data transfer portion 230, there is an effect in which the measurement of frequency characteristics or the failure diagnosis of the data line drive circuit 200 can be facilitated.

B. Second Embodiment

Figure 6:
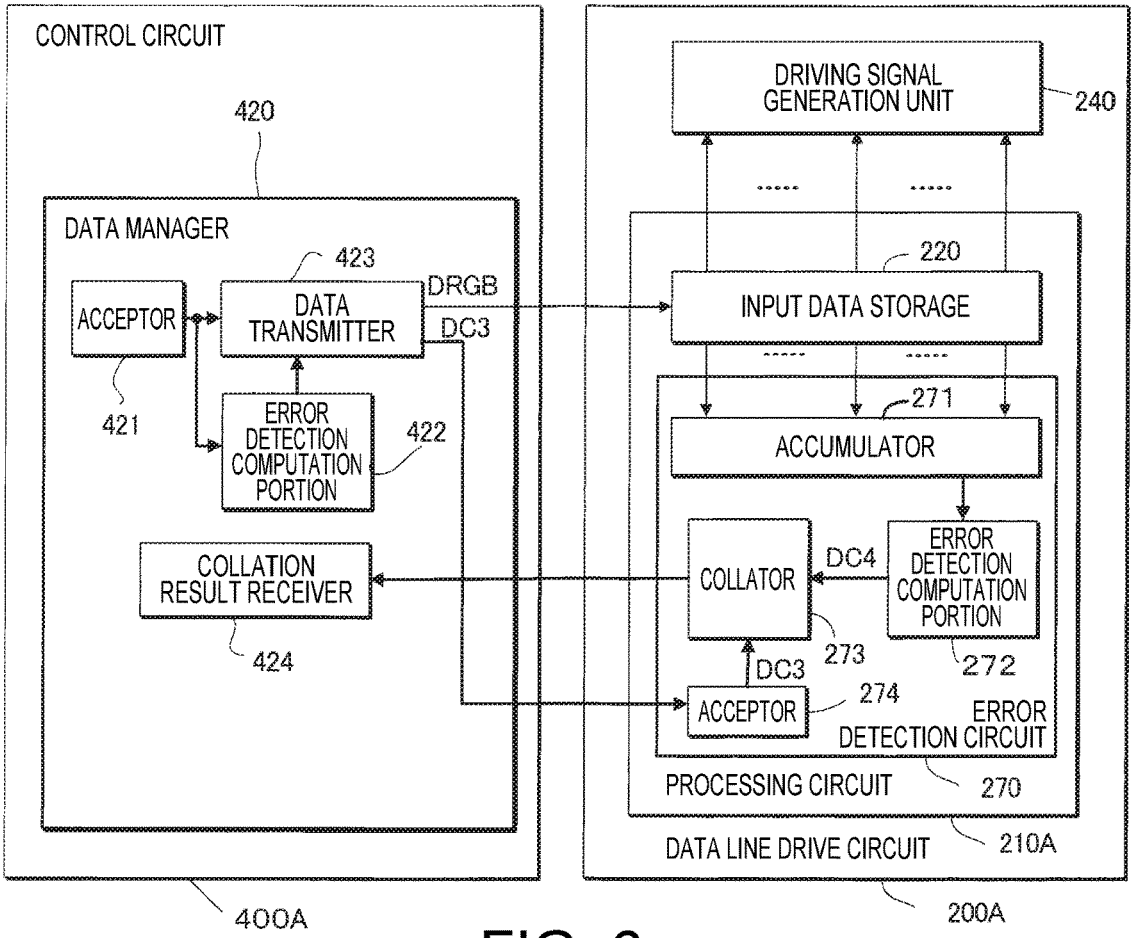
FIG. 6 is a block diagram illustrating a configuration of a control circuit and a data line drive circuit in a drive circuit according to a second embodiment.

FIG. 6 is a block diagram illustrating a configuration of a control circuit 400A and a data line drive circuit 200A in a drive circuit according to a second embodiment. In the first embodiment, the control circuit 400 includes the error detection circuit 410, as shown in FIG. 3. In contrast, in the present embodiment, a processing circuit 210A in the data line drive circuit 200A includes an error detection circuit 270.

The control circuit 400A includes a data manager 420. The data manager 420 includes an acceptor 421, an error detection computation portion 422, a data transmitter 423, and a collation result receiver 424.

The acceptor 421 is a circuit that receives input image data Din from the host processor 2000 shown in FIG. 1. The error detection computation portion 422 is a circuit that generates error detection data from the input image data Din accepted by the acceptor 421. In the present embodiment, the error detection computation portion 422 generate the error detection data from the input image data Din in units of one vertical scan period. The data transmitter 423 transmits, in each vertical scan period, the one vertical scan period's worth of input image data Din accepted by the acceptor 421 to the data line drive circuit 200A as the display image data DRGB. Here, the data transmitter 423 divides the one vertical scan period's worth of input image data Din into a plurality pieces of one horizontal scan period's worth of image data, and transmits each piece of image data to the data line drive circuit 200A in synchronization with the horizontal synchronizing signal Hsync.

Also, when the error detection computation portion 422 generates error detection data DC3 with respect to the one vertical scan period's worth of display image data DRGB to be transmitted to the data line drive circuit 200A, the data transmitter 423 transmits the error detection data DC3 to the data line drive circuit 200A in a vertical blanking period.

The data line drive circuit 200A includes the processing circuit 210A and a driving signal generation unit 240. The configuration of the driving signal generation unit 240 is similar to that of the first embodiment. The processing circuit 210A includes an input data storage 220 and the error detection circuit 270. The configuration of the input data storage 220 is similar to that of the first embodiment.

The error detection circuit 270 includes an accumulator 271, an error detection computation portion 272, a collator 273, and an acceptor 274. Every time the input data storage 220 stores one horizontal scan period's worth of display image data DRGB, the accumulator 271 accumulates this display image data. The error detection computation portion 272 generates error detection data DC4 from the one vertical scan period's worth of display image data accumulated in the accumulator 271. The acceptor 274 accepts the error detection data DC3 transmitted from the data transmitter 423 in the control circuit 400A. The collator 273 collates the error detection data DC4 generated by the error detection computation portion 272 with the error detection data DC3 accepted by the acceptor 274, and outputs a signal indicating the collation result. The collation result receiver 424 in the control circuit 400A receives the output signal from the collator 273.

As described above, in the present embodiment, the electro-optical device 1 includes the driving signal generation unit 240 that outputs driving signals to the electro-optical panel 10, the control circuit 400A that outputs display image data DRGB indicating an image to be displayed in the electro-optical panel 10, and the processing circuit 210A that generates input data to the driving signal generation unit 240 based on the display image data DRGB. The processing circuit 210A includes the error detection circuit 270 that detects an error in the input data. Therefore, according to the present embodiment, an error in the input data to the driving signal generation unit 240 can be detected by the error detection circuit 270 in the processing circuit 210A. Also, in the present embodiment, since the error detection circuit 270 in the processing circuit 210A detects an error in the input data to the driving signal generation unit 240, the processing circuit 210A need not transfer the input data to the control circuit 400A, and the number of interconnects between the processing circuit 210A and the control circuit 400A can be reduced relative to the first embodiment.

Also, in the present embodiment, the control circuit 400A outputs display image data DRGB and error detection data DC3 generated from the display image data DRGB to the processing circuit 210A. Therefore, according to the present embodiment, the error detection circuit 270 in the processing circuit 210A can detect an error in the input data using the error detection data DC3.

Also, in the present embodiment, the error detection circuit 270 includes the error detection computation portion 272 that generates error detection data DC4 from the input data, and the collator 273 that collates the error detection data DC4 with the error detection data DC3. Therefore, according to the present embodiment, an error in the input data to the driving signal generation unit 240 can be detected by collating the error detection data DC4 with the error detection data DC3.

Also, in the present embodiment, the control circuit 400A outputs the error detection data DC3 to the processing circuit 210A in a vertical blanking period. Therefore, according to the present embodiment, an error in the input data generated from display image data DRGB applied to the processing circuit 210A during a vertical scan period can be detected using the error detection data DC3 applied to the processing circuit 210A in a vertical blanking period.

Also, in the present embodiment, the data line drive circuit 200A includes the driving signal generation unit 240 that outputs driving signals to the electro-optical panel 10, the acceptor 274 that accepts display image data DRGB indicating an image to be displayed in the electro-optical panel 10 and the error detection data DC3 generated from the display image data, the input data storage 220 that output the display image data DRGB to the driving signal generation unit 240 as input data, the error detection computation portion 272 that generates error detection data DC4 from the input data, and the collator 273 that collates the error detection data DC3 with the error detection data DC4. Therefore, according to the present embodiment, an error in the input data to the driving signal generation unit 240 can be detected in the data line drive circuit 200A.

C. Other Embodiments

The first and second embodiments have been described above, but other embodiments are also possible. The following are other embodiments, for example.

(1) In the first embodiment, the error detection computation portion 414 provided in the error detection circuit 410 of the control circuit 400 generates the error detection data DC1 from the display image data DRGB. However, instead of this, the acceptor 411 in the error detection circuit 410 may accept input image data Din to which error detection data DC1 is added from the host processor 2000, and generate the display image data DRGB from the input image data Din. According to this mode, computation processing for generating the error detection data from the display image data DRGB in the error detection circuit 410 can be omitted.

(2) Both of the error detection in the control circuit illustrated in the first embodiment and the error detection in the data line drive circuit illustrated in the second embodiment may be performed.

(3) Error detection is performed with respect to one horizontal scan period's worth of display image data in the first embodiment, and error detection is performed with respect to one vertical scan period's worth of display image data in the second embodiment. However, the unit of image data with respect to which error detection is performed may be arbitrarily determined according to the scale and the target performance of the electro-optical device 1.

(4) In the first embodiment, an error in the input data is detected by collating the error detection data DC1 generated from the display image data DRGB and the error detection data DC2 generated from the image data DRGBO transferred by the data transfer portion 230. However, the method of detecting an error is not limited thereto. For example, an error in the input data may be detected, in the control circuit 400, by collating one horizontal scan period's worth of display image data transmitted to the processing circuit 210 with one horizontal scan period's worth of input data transferred from the data transfer portion 230.

(5) In the above embodiments, a liquid-crystal display panel is used as the electro-optical panel 10, but the embodiment is not limited thereto. For example, the present disclosure can be applied to an electro-optical device 1 including an electro-optical panel 10 other than the liquid-crystal display panel such as a display panel constituted by light emitting elements such as OLEDs (Organic Light-Emitting Diodes) and a display panel constituted by electrophoretic elements.

D. Application Examples

The electro-optical device 1 illustrated in the above modes can be used in various types of electronic apparatuses. FIGS. 7 to 10 illustrate specific modes of electronic apparatuses that have adopted the electro-optical device 1.

Figure 7:
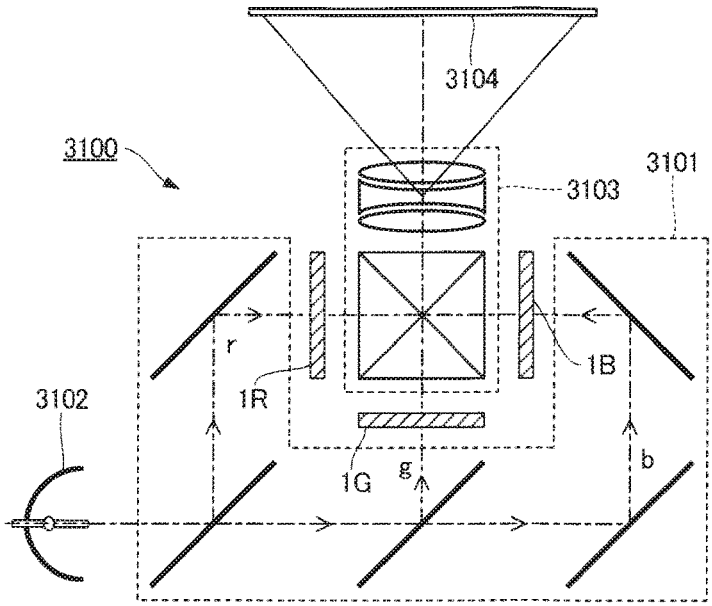
FIG. 7 is a schematic diagram of a projection type display device, which is an application example.

FIG. 7 is a schematic diagram of a projection type display device 3100 to which electro-optical devices 1R, 1G, and 1B each having a similar configuration as the electro-optical device 1 are applied. The projection type display device 3100 includes the three electro-optical devices 1R, 1G, and 1B corresponding to different display colors, specifically red, green, and blue. A lighting optical system 3101 supplies, of emitted light from a lighting device 3102, a red component r to the electro-optical device 1R, a green component g to the electro-optical device 1G, and a blue component b to the electro-optical device 1B. Each electro-optical device 1 functions as an optical modulator that modulates monochromatic light supplied from the lighting optical system 3101 according to a display image. The projection optical system 3103 combines the beams of emitting light from the respective electro-optical device 1, and projects the combined light on a projection plane 3104. An observer views the image projected on the projection plane 3104.

Figure 8:
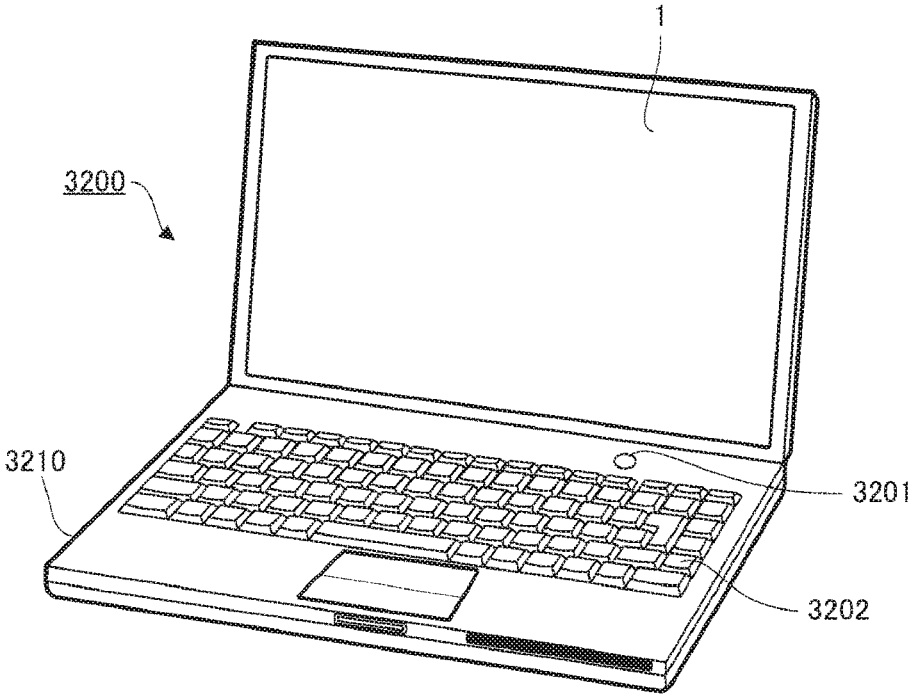
FIG. 8 is a schematic diagram of a personal computer, which is an application example.

FIG. 8 is a perspective view of a portable personal computer 3200 that has adopted the electro-optical device 1. The personal computer 3200 includes the electro-optical device 1 that displays various types of images and a body portion 3210 in which a power switch 3201 and a keyboard 3202 are provided.

Figure 9:
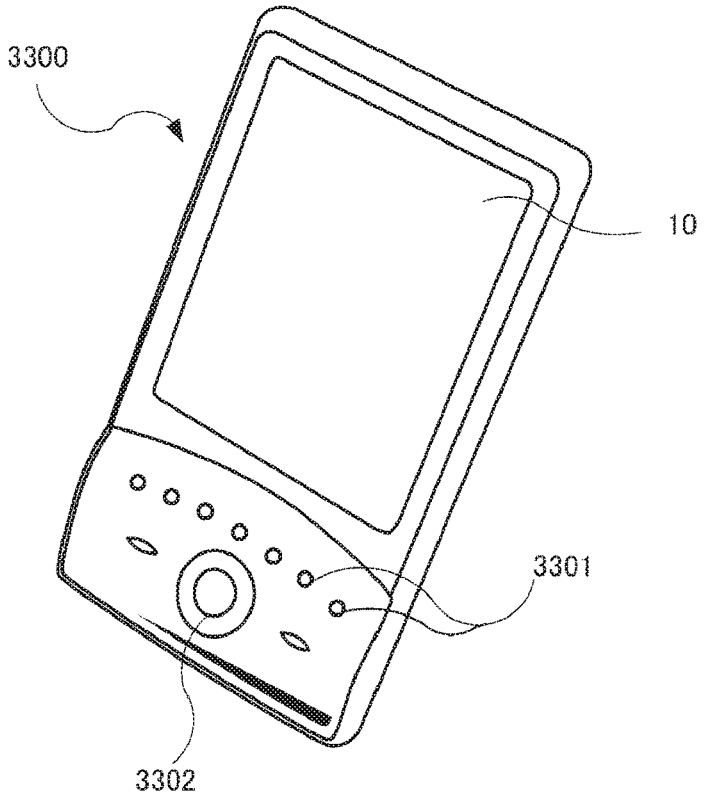
FIG. 9 is a schematic diagram of a mobile phone, which is an application example.

FIG. 9 is a diagram illustrating an exemplary configuration of an information mobile terminal (PDA: Personal Digital Assistants) to which the electro-optical device 1 has been applied. The information mobile terminal 3300 includes a plurality of operation buttons 3301, a power switch 3302, and the electro-optical device 1 serving as a display unit. When the power switch 3302 is operated, various types of information such as an address book and a schedule book are displayed in the electro-optical device 1.

The electronic apparatuses to which the electro-optical device 1 is applied include, other than the apparatuses illustrated in FIGS. 7 to 9, a digital still camera, a television, a video camera, an electronic organizer, electronic paper, an electronic calculator, a word processor, a workstation, a video telephone, a POS terminal, a printer, a scanner, a copier, a video player, an apparatus including a touch panel, and the like.

Figure 10:
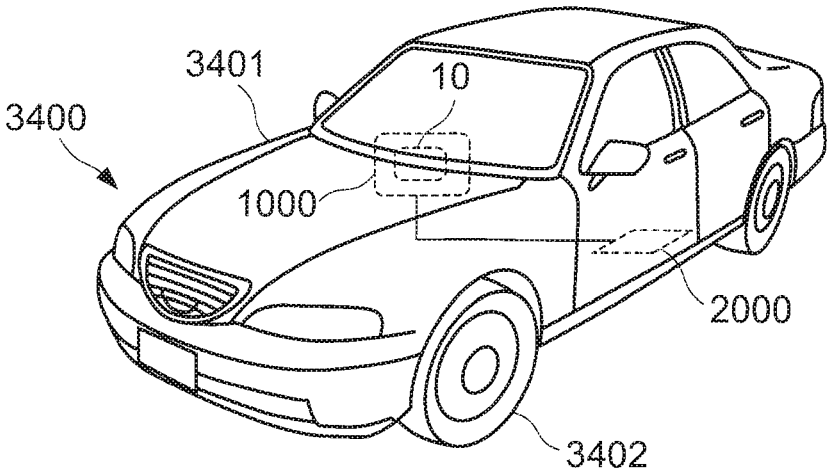
FIG. 10 is a schematic diagram of a mobile body, which is an application example.

FIG. 10 illustrates an exemplary configuration of a mobile body to which the electro-optical device 1 has been applied. The mobile body is an apparatus or a device that includes a drive mechanism such as an engine or a motor, steering mechanisms such as a steering wheel or a rudder, and various electronic apparatuses, for example, and moves on the ground, in the air, and on the sea. A car, an airplane, a motorcycle, a ship, a robot, or the like can be envisioned as the mobile body. FIG. 10 schematically illustrates an automobile 3400 serving as a specific example of the mobile body. The automobile 3400 includes a car body 3401 and wheels 3402. The electro-optical panel 10, the drive circuit 1000, and the host processor 2000 that controls the units of the automobile 3400 are incorporated in the automobile 3400. The host processor 2000 can include an ECU or the like. The electro-optical panel 10 is a panel apparatus such as a meter panel. The host processor 2000 generates an image for presenting to a user, and transmits the image to the drive circuit 1000. The drive circuit 1000 displays the received image in the electro-optical panel 10. For example, pieces of information such as speed, a remaining fuel amount, a travel distance, and settings of various devices are displayed as an image.

What is claimed is:

1. A drive circuit comprising:

a driving signal generation unit that outputs a driving signal to an electro-optical panel;

a control circuit that outputs display image data indicating an image to be displayed in the electro-optical panel; and a processing circuit configured to generate input data to the driving signal generation unit based on the display image data, wherein the processing circuit includes a data transfer portion configured to transfer the input data to the control circuit, and the control circuit includes an error detection circuit configured to detect an error in the input data.

2. The drive circuit according to claim 1, wherein the error detection circuit includes:

a first error detection data storage that stores first error detection data generated from the display image data that the control circuit outputs to the processing circuit;

an error detection computation portion configured to generate second error detection data generated from the input data transferred from the data transfer portion; and a collator configured to collate the first error detection data with the second error detection data.

3. The drive circuit according to claim 2, wherein the error detection computation portion is configured to generate the first error detection data from the display image data.

4. The drive circuit according to claim 2, wherein the error detection circuit includes:

an acceptor that accepts input image data to which the first error detection data is added, and the error detection circuit is configured to generate the display image data from the input image data.

5. The drive circuit according to claim 1, wherein the driving signal includes a first driving signal and a second driving signal, the electro-optical panel includes a first data line and a second data line, the processing circuit includes an input data storage that stores the display image data including first image data and second image data, and outputs the input data including the stored first image data and second image data, the driving signal generation unit outputs the first driving signal to the first data line based on the first image data in the input data, and outputs the second driving signal to the second data line based on the second image data in the input data, and the data transfer portion performs a parallel input operation for taking in the input data from the input data storage at the same time, and a serial output operation for sequentially outputting the taken-in input data including the first image data and the second image data to the control circuit.

6. The drive circuit according to claim 5, wherein the input data storage sequentially stores the display image data including the first image data and the second image data in synchronization with a first clock, and outputs the stored display image data including the first image data and the second image data as the input data in synchronization with a second clock, and the data transfer portion performs the serial output operation in synchronization with a third clock in a period in which the input data storage stores the display image data including the first image data and the second image data.

7. An electro-optical device comprising the drive circuit according to claim 1.

8. An electronic apparatus comprising the drive circuit according to claim 1.

9. A mobile body comprising the drive circuit according to claim 1.

10. A data line drive circuit comprising:

a driving signal generation unit that outputs a driving signal to an electro-optical panel;

an input data storage that receives display image data indicating an image to be displayed in the electro-optical panel, and outputs the received data to the driving signal generation unit as input data; and a data transfer portion configured to transfer the input data to the outside.

11. An electro-optical device comprising the data line drive circuit according to claim 10.

12. An electronic apparatus comprising the data line drive circuit according to claim 10.

13. A mobile body comprising the data line drive circuit according to claim 10.

* * * * *